US005316267A

United States Patent [19]

Nishi et al.

[11] Patent Number: 5,316,267

[45] Date of Patent: May 31, 1994

[54] HOIST INCLUDING GUARDS WITH CHAIN SWELLING AND TWIST CORRECTIVE SURFACES

[75] Inventors: Yoshio Nishi; Haruo Kubota; Yoshio Ueno, all of Osaka Sayama, Japan

[73] Assignee: Elephant Chain Block Company Limited, Osaka, Japan

[21] Appl. No.: 865,883

[22] Filed: Apr. 9, 1992

[30] Foreign Application Priority Data

Oct. 31, 1991 [JP] Japan ..... 3-286894

[51] Int. Cl.[5] ..... B66D 1/36; B66D 3/02

[52] U.S. Cl. ..... 254/383; 254/372

[58] Field of Search ..... 254/271, 281, 283, 360, 254/371, 372, 383, 389, 333; 474/9, 210, 140, 144

[56] References Cited

U.S. PATENT DOCUMENTS

| | | | |
|---|---|---|---|
| 1,458,354 | 6/1923 | Neller | 254/372 |
| 1,572,001 | 2/1926 | Dotzert | 254/383 |
| 2,240,523 | 5/1941 | Scramm | 254/372 X |
| 2,342,091 | 2/1944 | Schroeder | 254/372 |
| 2,477,783 | 8/1949 | Britt | 254/168 |
| 2,529,084 | 11/1950 | King | 254/383 |
| 2,656,150 | 10/1953 | Lock | 254/383 X |
| 3,056,586 | 10/1962 | Burrows | 254/271 |
| 4,260,136 | 4/1981 | Harman et al. | 254/372 X |
| 5,007,617 | 4/1991 | Nishimura et al. | 254/372 |

FOREIGN PATENT DOCUMENTS

| | | |
|---|---|---|
| 0063055 | 2/1967 | Australia . |
| 2548569 | 6/1976 | Fed. Rep. of Germany . |
| 1215373 | 4/1960 | France . |
| 0026065 | 2/1990 | Japan . |
| 0629671 | of 1949 | United Kingdom . |

*Primary Examiner*—Clifford D. Crowder
*Assistant Examiner*—Ismael Izaguirre
*Attorney, Agent, or Firm*—Stevens, Davis, Miller & Mosher

[57] ABSTRACT

A lever type traction machine including a pair of chain holders for holding a chain entering, between side plates, towards the load sheave. Each of the chain holders is provided with a chain-swelling (slacking) restraint portion for preventing the drain from slacking at the rear of the chain holders. The machine is especially advantageous in that the chain will not become entangled or slackened, even if the traction machine is operated up-side down or on its side.

4 Claims, 3 Drawing Sheets

HOIST INCLUDING GUARDS WITH CHAIN SWELLING AND TWIST CORRECTIVE SURFACES

FIELD OF THE INVENTION

The present invention relates to a lever type traction machine, and more particularly to a lever type traction machine which interposes between side plates a load sheave engageable with a chain so that the load sheave is driven by operating an operating lever so as to haul the chain.

BACKGROUND OF THE INVENTION

Conventionally, such a lever type traction machine has been proposed, which as disclosed in, for example, the Japanese Utility Model Publication Gazette No. Hei 2-6065 and shown in FIG. 5, is so constructed that a load sheave A engageable with a chain B is rotatably interposed between side plates; an operating lever is operated to drive a driving shaft S directly connected to or in association with the load sheave A through a speed reduction mechanism so as to haul the chain B engaged with the load sheave A, and a pair of chain holders, C1 and C2 are provided between the side plates, at both radial sides of the load sheave A for guiding therebetween the entering chain B to load sheave A.

The chain holders C1 and C2 in the lever type traction machine, as shown in FIG. 5, each form a guide surface in a circular arc at the opposite surface to the load sheave A, and the guide surface is formed in a circular arc around the center apart from the guide surface with respect to the axis of the driving shaft so that the chain B entering between the side plates can be guided toward the load sheave A.

At both side surfaces of the respective chain holders C1 and C2 are provided circular projections to be fitted into fitting bores provided at the side plates, respectively. Insertion bores F are also provided for receiving stay bolts E for fixing the side plates, respectively. The stay bolts E are screwably tightened by nuts so as to fixedly maintain each chain holder C1 or C2 between the side plates at the two positions of the projection D and stay bolt E.

In the lever type traction machine constructed as above, the guide surface at each chain holder C1 or C2 is formed in a circular arc and a wide forward gap is provided between the guide surface and the load sheave A in the entering direction of the chain, whereby the chain B can properly be guided, so as to enter between the side plates toward the load sheave A and prevented from rising with respect to the load sheave A at the portion of a smaller gap. However, the guide surface of each chain holder C1 or C2 similarly is formed in a circular arc which is wide rearwardly in the entering direction, whereby, when the chain is hauled, the load sheave is free-rotatably controlled so as to adjust the chain in length as discussed below, or load traction is released in the state where the lever type traction machine is turned sidewise or upside down. That is, in the state where the drawing plane in FIG. 5 is turned upside down, the chain B engaging with the load sheave A may be swollen (slackened) due to gravity rearwardly in the entering direction of the chain B with respect to each chain holder C1 or C2. Such a swollen chain B interferes with the stay bolt E, or links of the chain B become intertwined with each other, thereby creating the problem in that the load sheave A is hindered from being smoothly driven.

The traction machine, usually, makes the load sheave freely rotatable in the traction direction or the traction releasing direction as the above-mentioned, but since the guide surface of each holder C1 or C2 is formed in a circular arc, when the chain B is intensively hauled in the twisted condition during the free rotation operation, the chain B may enter between each chain holder C1 or C2 and the load sheave. As the result, a problem is created in that the chain B is caught by the chain holder C1 or C2, thus locking the free rotation of the load sheave A.

The chain holders C1 and C2 each fit the fitting projection D into the round fitting bore at each side plate and insert the stay bolt E into the insertion bore F, so as to be fixedly sandwiched between the side plates while being locked at the two positions of the projection D and stay bolt E. Hence, the chain holders C1 and C2 must be constructed to form thereon the insertion bores F, other than projections D, so as to be complicated in construction and requiring much time for machining. Also, the chain holders are large-sized and heavy due to the formation of the insertion bores F. Moreover, the chain holders C1 and C2, when fixedly placed between the side plates, require much time to insert the stay bolts E into the insertion bores F, respectively, thereby creating the problem in that the assembly is complicated.

SUMMARY OF THE INVENTION

An object of the present invention is to provide a lever type traction machine which, even when operated for traction in the state where it is turned sidewise or upside down or the load sheave is intended to freely rotate, can prevent the chain from swelling (slacking) rearwardly in the entering direction thereof at a chain guide.

A lever type traction machine of the present invention which interposes between side plates a load sheave engageable with a chain so as to drive the load sheave by operation of an operating lever 14 and to haul a chain carrying a load attached thereto, is characterized in that a pair of chain holders, are disposed at both radial sides of the load sheave, for holding the entering chain toward the load sheave, between the side plates and that a chain swelling restraint portion is provided for restraining the chain from swelling radially of the load sheave at the rear side of each chain holder in the entering direction of the chain when entering between the side plates from the outside thereof to the inside.

It is preferable that a guide, for correcting twist of the chain entering between the load sheave and the chain holder, is provided in front of the load sheave in the entering direction of the chain.

Also, it is preferable that, at the side surfaces of each chain holder opposite to the side plates, are provided rectangular projections projecting from the side surfaces; that, at chain holder mounting portions at the side plates, are provided rectangular bores engageable with the rectangular projections, respectively and that the side plates are fixed to each other through a plurality of stay bolts, so that, when the side plates are fixed through the stay bolts, the chain holders are sandwiched between the side plates.

Accordingly, when the lever type traction machine hauls a load, releases the traction, or freely rotates the load sheave while being turned sidewise or upside down, the chain, which enters between the side plates from the outside thereof to the inside, is guided by one chain holder positioned at the entering side and engages with the load sheave and is prevented from rising with respect thereto. At this time, the chain which enters between the side plates and then leaves the chain holder at the chain entering side, is intended to swell by the gravity of the chain at the rear of the chain holder. However, at the rear portion of each chain holder is provided the chain swelling restriction portion, whereby the chain is restrained thereby from swelling. Accordingly, the chain having passed the chain holder is guided toward the load sheave without swelling, and then guided toward the other chain holder, while engaging with the load sheave. Hence, the chain can be prevented from swelling to interfere with a stay bolt or intertwining chain links with each other to cause locking of the rotation of load sheave.

At the front of each chain holder in the entering direction of the chain toward the load sheave is provided a guide for correcting twists of the chain. So that, when the load sheave is operated to freely rotate, even if the chain is intended to enter between the load sheave and the chain holder while being twisted, the guide can forcibly correct and eliminate the twist of the chain. Hence, there is no fear that the twisting chain will be caught by the chain holder at the front thereof in the chain entering direction so as to lock the load sheave.

At the side surfaces of each chain holder, opposite to the side plates, are provided rectangular projections projecting from the side surfaces. At the chain holder mounting positions of the side plates are provided rectangular fitting bores into which the rectangular projections are fitted respectively, so that the chain holders can be fixedly sandwiched between the side plates by means of the stay bolts therefor, thereby enabling the chain holders to be not-rotatably fixed to the side plates. Therefore, the chain holders need not be fixed by stay bolts perforating therethrough as in the conventional example, whereby the chain holders can be simply constructed, machined, and assembled, and can be miniaturized and made lightweight.

These and other objects of the invention will be seen by reference to the description, taken in connection with the accompanying drawings.

DETAILED DESCRIPTION OF THE PRESENT INVENTION

Figure 4:
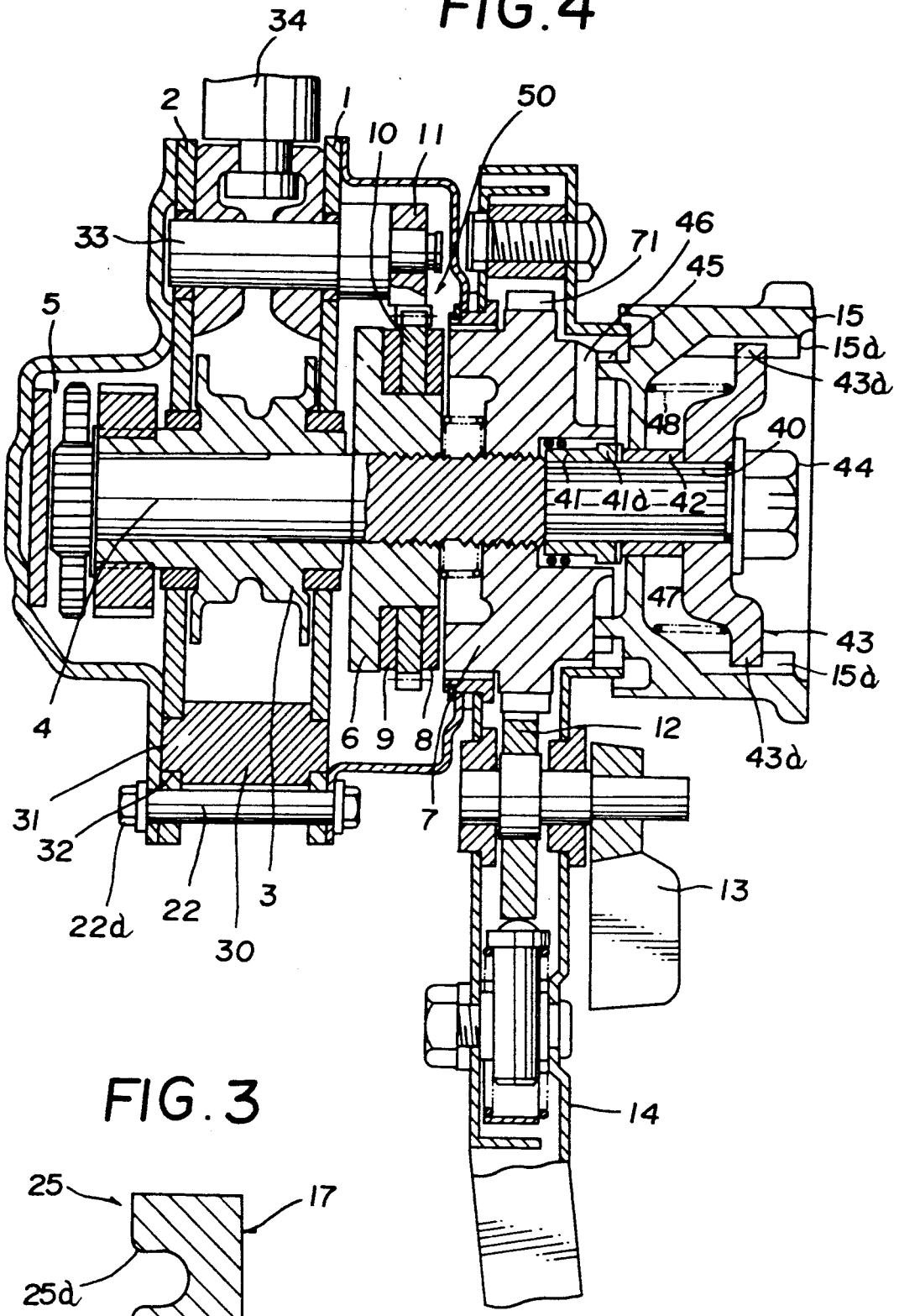
FIG. 4 is a sectional view of a lever type traction machine to which the present invention is applied.

The lever type traction machine shown in FIG. 4 is a typical embodiment of the present invention, which is so constructed that a load sheave 3, into which a driving shaft 4 is so as to be relatively-rotatable thereto inserted, is rotatably supported to first and second side plates 1 and 2 disposed opposite to each other and spaced at a predetermined interval, and a reduction gear mechanism 5, comprising a plurality of reduction gears, is interposed between the axially outside end of the driving shaft 4, projecting from the second side plate 2, and the load sheave 3. The reduction gear mechanism 5 reduces the rotation speed of the driving shaft 4 to be transmitted to the load sheave 3. The first and second side plates 1 and 2 are fixed to each other and spaced at a predetermined interval through four stay bolts shown in FIG. 1. A mounting shaft 33, for mounting a hook 34, is supported between the side plates 1 and 2 and at one side on the tangential line of the load sheave 3 (at the upper sides in FIGS. 1 and 4).

A driven member 6, having a flange, is screwably connected with the axially outside portion of the driving shaft 4 projecting from the first side plate 1. A driving member 7, provided at the outer periphery thereof with toothed portions 71, is screwed with the driving shaft 4 at the axial outside of the driven member 6; between the driving member 7 and the driven member 6 is interposed a braking ratchet wheel 10 put between a pair of linings 8 and 9. Outside the first side plate 1, and at an extension of the mounting shaft 33, is mounted a braking pawl 11 engageable with the braking ratchet wheel 10 to block reverse rotation thereof. The above components form mechanical brake 50.

Furthermore, at the radial outside of the driving member 7 is provided an operating lever 14 having a pawl member 12 provided with a normal and reverse rotation pawl engageable with the toothed portions provided at the outer periphery of the driving member 7 and an operating portion 13 for engaging or disengaging the pawl member 12 with or from the toothed portions. The lever 14 is operated to rotate the driving member 7 normally or reversely through the pawl member 12, which is selectively engageable with the toothed portions 71, thereby hauling or loosening the chain engaging with the load sheave 3.

A free rotation control mechanism, for making the load sheave 3 freely rotatable, is provided axially outside of the driving member 7. In detail, at the axially outer end of driving shaft 4 is provided serration 40, onto which a pair of sleeves 41 and 42 are fitted; a flange 41*a* is provided at the first sleeve 41; a stopper 43 is serration-coupled with the axial end of serration 40 at the axial outside of the second sleeve 42; a nut 44 screws with a screw thread at the driving shaft 4, at the axial outside of the serration 40; and the nut 44 is tightened to fix the stopper 43 to the driving shaft 4 through the sleeves 41 and 42.

An operating handle 15 is fitted onto the second sleeve 42 and interposed between the stopper 43 and the driving member 7 so as to be axially movable with respect to the driving shaft 4 and rotatable. Ridges 15*a*, provided at the inner periphery of the operating handle 15, with engaging grooves 43*a*, provided at the outer periphery of stopper 43 respectively; whereby the operating handle 15 is made to be non-rotatable with respect to the driving shaft 4, through the stopper 43.

Between the operating handle 15 and the stopper 43 is provided an elastic biasing member 48 comprising a coil spring in contact with the side surfaces of the operating handle 15 and stopper 43. The elastic member 48 biases the operating handle 15 towards the flange 41*a* at the first sleeve 41, in other words, in the direction of moving away from the stopper 43, that is, toward the driving member 7.

Furthermore, at the radial end of the rear surface of a boss of the operating handle 15 is provided two engaging projections 45 projecting toward the driving member 7. At the opposite side of driving member 7, with respect to the boss of the operating handle 15, is symmetrically provided a pair of projections 46. At the projections 46 are provided free rotation control surfaces 47, which when the operating handle 15 is moved away from the driving member 7 and rotated relative thereto, are biased by the elastic biasing member 48 so as to be brought into contact with the utmost projecting ends of the engaging projections 45. In the case where the free rotation control mechanism is operated, at first, the operating handle 15 is moved away from the driving member 7 and, in this state, is rotated to engage the engaging projections 45 with the free rotation control surfaces 47 as shown in FIG. 4. At this time since the driving shaft 4 rotates normally, the driving member 7 screws backwardly from the driven member 6. Accordingly, in this date, the load sheave 3 becomes freely rotatable and, since the engaging projections 45 are biased by the elastic brasing member 48 so as to come into elastic contact with the free rotation control surfaces 47, the driving member 7 is given resistance against its relative rotation with respect to the driving shaft 4 so as to rotate together therewith under the resistance, thereby maintaining the load sheave 3 in the free rotation state. Accordingly, the chain engageable with the load sheave 3 can freely be drawn out at the load or no-load side due to the free rotation of load sheave 3.

In such a state, when the chain is intensively pulled at the load side so as to be loaded, greatly the driving member 7 overcomes the resistance to rotate with respect to the driving shaft 4 and the free rotation control is released, thus leading to reoperation of the mechanical brake 50.

Figure 1:
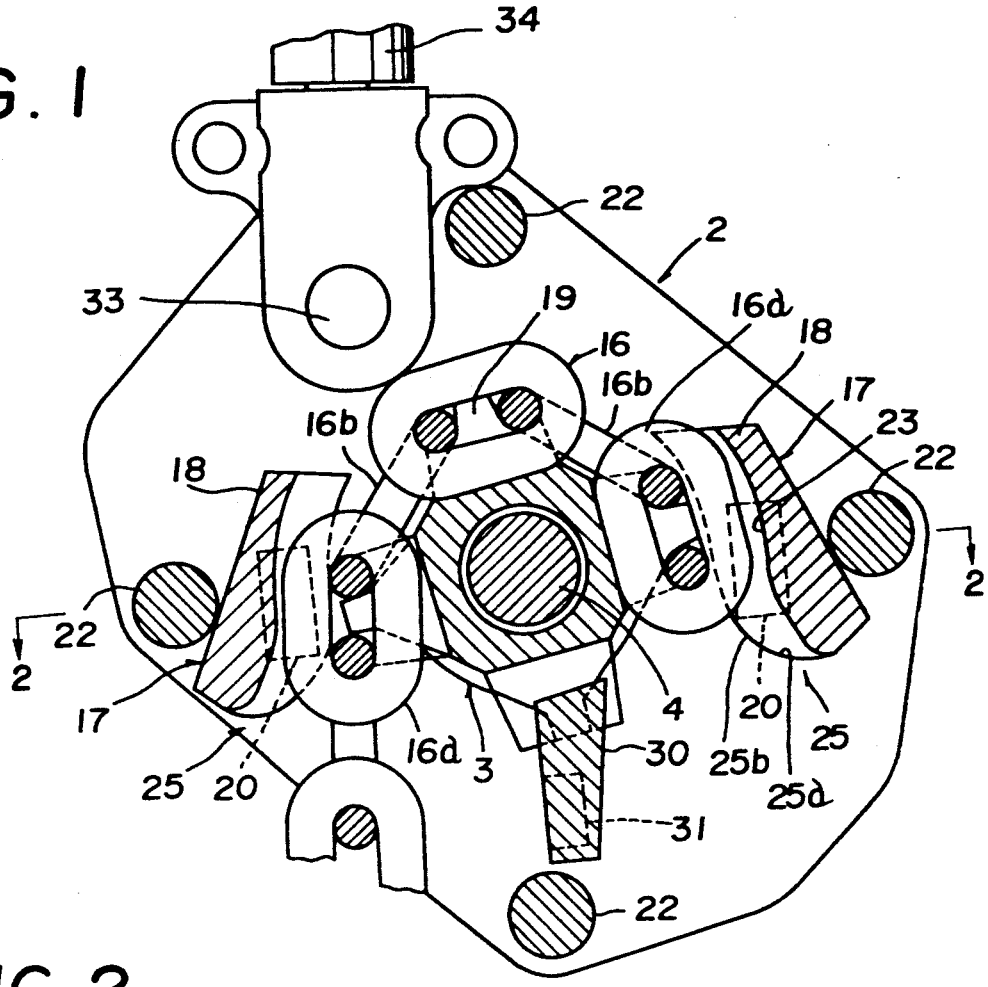
FIG. 1 is a sectional view of the principal portion of a lever type traction machine of the present invention.

In the FIG. 1 embodiment of the lever type traction machine of the present invention constructed as above, at both radial sides of the load sheave 3 are disposed a pair of chain holders 17 for holding the chain 16 entering between the side plates 1 and 2 to engage with the load sheave 3 toward the load sheave 3. The chain holders 17 are provided at the rear side of load sheave 3 with respect to the entering direction of the chain with chain swelling restraint portions 18 for restraining the chain 16 from radially swelling from the load sheave 3 at the rear side thereof. Chain swelling restraint portions 18 are provided between chain holders 17 and load sheave 3.

In other words, as shown in FIG. 1, a plurality of projections 19 are provided at the load sheave 3, engageable with the chain 16, for catching the chain 16. Accordingly when the load sheave 3 rotates, the chain 16 is adapted to be drawn to between the side plates 1 and 2 through the projections 19. Namely, when the load sheave 3 is driven normally (e.g., clockwise in FIG. 1) the chain 16 is hauled at the load side (the left-side in FIG. 1) so as to enter between the side plates 1 and 2 from the outside thereof to the inside and is guided by one chain holder 17, provided at the load side, so as to rotatably engage with the load sheave 3 without rising therefrom. The chain 16 is guided by the other chain holder 17, provided at the no-load side, so as to be drawn out from between the side plates 1 and 2.

When the load sheave 3 is rotated in reverse (e.g. counterclockwise in FIG. 1) the chain 16 enters at the no-load side (right side in FIG. 1) from the outside of the side plates to the inside thereof, is guided by the other chain holder 17 provided at the no-load side so as to rotatably engage with the load sheave 3 without rising therefrom, and is guided by the other chain holder 17, provided at the load side, so as to be drawn out from between the side plates 1 and 2.

Figure 2:
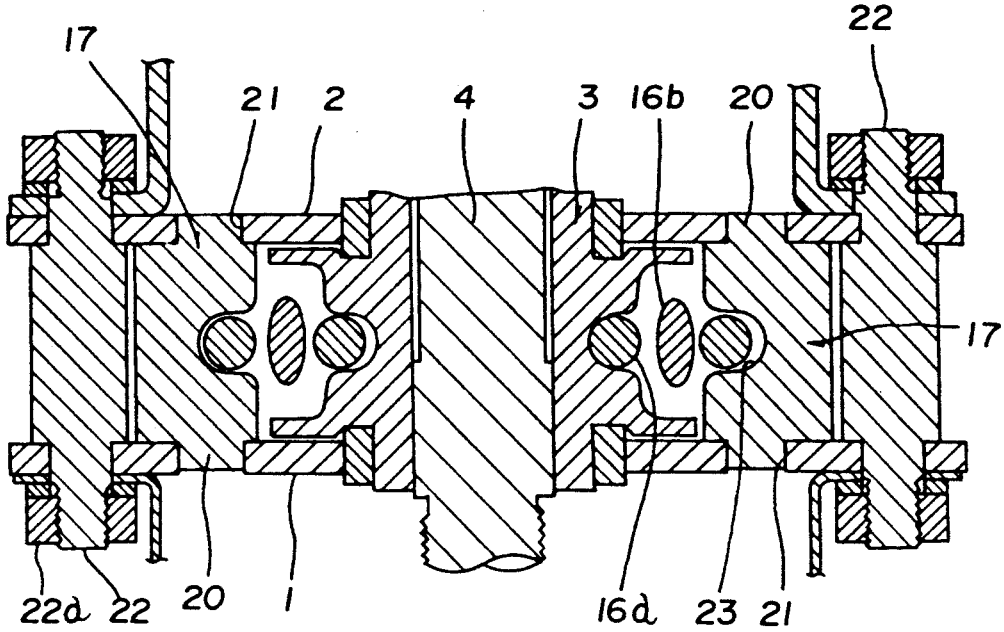
FIG. 2 is an enlarged sectional view taken on the line 2—2 in FIG. 1.

In the above-mentioned construction, when the load sheave 3 is rotated normally, the chain 16 enters at the load side thereof in between the side plates 1 and 2 from the outsides thereof to the inside. When reversely rotated, the chain 16 enters at the no-load side, as mentioned above. The chain holders 17, as shown in FIGS. 1 and 2, are provided at both the inside surfaces with rectangular projections 20, respectively. In addition, rectangular fitting bores 21, into which the rectangular projections 20 are fitted, are provided at the side plates 1 and 2. Inside of the stay bolts 22 provided at both lateral sides of the load sheave 3 respectively, the rectangular projections 20 are fitted into the rectangular fitting bores 21, and nuts 44 are fixedly screwed with the stay bolts 22 respectively, thereby non-rotatably sandwiching the chain holders 17 between the side plates 1 and 2.

Each chain holders 17 is heat-treated to improve its strength to bear contact with the chain 16 and is formed with a groove 23 at the opposite surface to the load sheave 3. The at the bottom of the groove 23, as shown in FIGS. 1 and 2, forms a biasing surface for biasing a vertical link **16*a* toward the load sheave 3, and the inner surfaces of the groove 23 form biasing surfaces for biasing a horizontal link 16*b*. As shown in FIG. 1, these biasing surfaces each are formed in an inwardly facing circular arc around the axis of load sheave 3, thereby biasing toward the load sheave 3 the chain 16 engaging therewith. The chain swelling restraint portions 18 are provided at the chain holders 17 and at the rear side in the entering direction of the chain 16, which enters between the side plates 1 and 2 from the outside thereof to the inside, and guide portions 25 are provided at the chain holders 17 and at the front of the entering direction of the chain 16. Thus if chain 16 enters twisted, it is forcibly corrected to remove the twist of chain 16**.

The chain swelling restraint portions 18, as shown in FIG. 1, are each extended at the rear portion of the biasing surface in the chain entering direction to be formed along the rotation path of the load sheave 3. When the chain 16, guided by the biasing surface, is disposed so as to swell in the tangential line of the rotary path of load sheave 3, the chain swelling restraint portions 18 can restrain the chain 16 from swelling.

Figure 3:
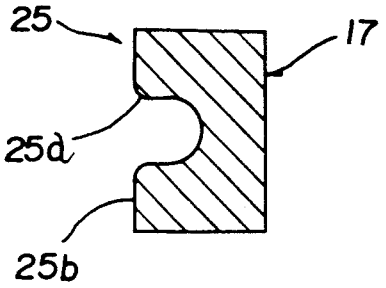
FIG. 3 is an enlarged sectional view of a guide at a chain holder.
Figure 5:
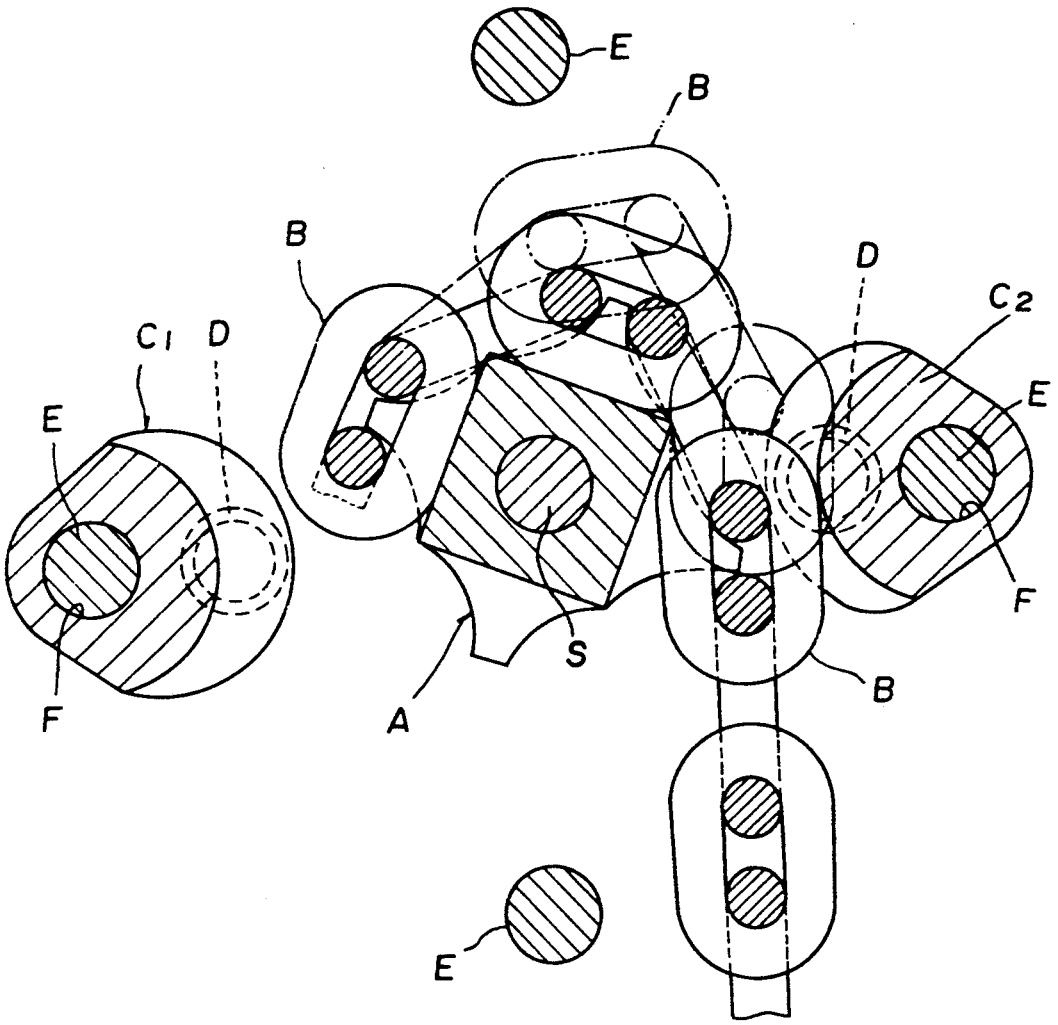
FIG. 5 (PRIOR ART)
FIG. 5 is a sectional view explanatory of the problem in the conventional example.

Each guide 25 is formed in such a manner that each biasing surface is somewhat extended at the front, with respect the chain entering direction, along the tangential line of the rotary path of the load sheave 3 and then outwardly extended in an outwardly facing circular arc and thus formed in continuation of the groove 23. As shown in FIG. 3, each corner between the biasing surface for the horizontal link **16*b* and the groove 23 is rounded so that at the round corner is formed a first correction portion 25*a* for correcting the twist of the vertical link 16*a*. Each inner surface of the guide 25 in continuation of the biasing surface for the horizontal link 16*b*, that is, each inner surface positioned at both sides of the groove 23, forms a second correcting portion 25*b* for correcting the twist of the horizontal link 16*b***.

In addition, in FIG. 1, reference numeral 30 designates a chain stopper placed between the side plates 1 and 2. The chain stopper 30 has at both lateral sides rectangular projections 31, similar to the chain holder 17. The projections 31 are fitted into rectangular fitting bores 32 provided at the side plates 1 and 2. The chain stopper 30 and the chain holders 17 are sandwiched between the side plates 1 and 2.

Next, explanation will be given on operation of the lever type traction machine constructed as mentioned above.

At first, when the chain 16 is hauled, the operating lever 14 is operated to normally rotate the driving member 7 and the driving shaft 4 is driven through the mechanical brake 50 so as to rotate the load sheave 3 normally, (e.g. clockwise in FIG. 1). When traction is released, the operating lever 14 is operated to reversely rotate the driving member 7 and release the mechanical brake 50. Therefore, the driving shaft 4 and load sheave 3 are rotatable, (e.g. counterclockwise in FIG. 1), thereby reversely rotating the load sheave 3 due to the load. In addition, such reverse rotation is limited in a range of reversely rotating the driving member 7 by operating the operating lever 14. When the reverse rotation exceeds this range, the mechanical brake 50 acts to block further reverse rotation. Accordingly, the operating lever 14 is repeatedly operated to enable the traction to be released.

In the no-load state when traction is released, the chain 16 is drawn out from the load sheave 3 to the load side or retracted to the no-load side. In brief, when the load sheave 3 is controlled to be in the free rotation state so as to adjust the length of chain 16, the operating handle 15 is operated as mentioned above.

It is not problematical that the lever type traction machine hauls the load, releases the traction or free-rotation-controls to adjust the chain 16 in length while being kept vertical; that is, as shown in FIG. 1. However, when the same is turned sidewise or upside down, that is, when the picture plane of FIG. 1 is reversed, especially when the traction is released or the load sheave 3 is free-rotation-controlled to adjust the chain length of the, chain 16 entering from the outside to the inside of side plates 1 and 2 tends to swell at the rear of each chain holder 17, but since each chain holder 17 is provided with the chain swelling restraint portion 18, the chain 16 can be restrained from swelling at the rear of the chain holder 17, whereby the chain 16 can be prevented from interfering with the stay bolt 22 or the hook mounting portion 32, or from intertwining with itself to hinder smooth rotation of the load sheave 3 by locking its rotation.

In the case where the load sheave 3 is freely-rotatably controlled to adjust the length of the chain 16, when the chain 16 is intensively pulled or is intended to enter while being twisted between the load sheave 3 and the chain holder 17, the vertical links **16*a* and horizontal links 16*b* of the chain 16 are all corrected by the guide 25, whereby the twist of chain 16 is eliminated and the chain 16 enters between the chain holder 17 and the load sheave 3. Accordingly the chain 16 can be prevented from being caught by the chain holder 17 at the front thereof in the entering direction, which leads to locking of rotation of the load sheave 3**.

The chain holders 17 are sandwiched between the side plates 1 and 2, by fitting the rectangular projections 20 thereof into the rectangular bores 21 at the side plates 1 and 2, and are fixed thereto by the stay bolts 22, thereby being restricted from rotation. Also, each chain holder 17, as shown in FIG. 1, is positioned inside of and close to the stay bolts 22, and can come into contact at the rear surface therewith. Accordingly, the counterclockwise rotation moment of the chain 16, acting on each chain holder 17, can also be carried by the stay bolt 22.

The chain holders 17 are not constructed to allow the stay bolt 22 to perforate therethrough as the conventional machine, thereby being simpler in construction, resulting in that the same can be miniaturized, and can be simply machined and assembled.

As seen from the above, in the lever type traction machine of the present invention which is so constructed that the load sheave 3, engageable with the chain 16, is interposed between the side plates 1 and 2 and the operating lever 14 is operated to drive the load sheave 3 so as to haul the chain 16, a pair of chain holders 17, which hold toward the load sheave 3 the chain 16 entering between the side plates 1 and 2 to engage with the load sheave, are provided. At the rear side of each chain holder 17 in the entering direction of the chain 16, which enters between the side plates 1 and 2 from the outside to the inside thereof, is provided the chain swelling restraint portion 18 for restraining the chain 16 from swelling radially outwardly of the load sheave 3, so that in a case where the lever type traction machine is operated while being turned sidewise or upside down, especially when the traction is released or the load sheave 3 is free-rotatably controlled to adjust the chain 16 in length, the chain swelling restraint portions 18 can restrain the chain 16 from swelling, even when chain 16 would tend to swell due to gravity at the rear side of chain holder 17. Accordingly, the chain 16, which does not swell at the rear side of the chain holder 17, can be prevented from swelling and interfering with the stay bolt or the like or intertwining with itself to hinder smooth rotational of the load sheave 3.

The guides 25, provided in the front with respect to the entering direction of the chain 16 in between the load sheave 3 and the chain holder 17, are for correcting twists in the chain 16. Even when the chain 16 is intensively pulled during the free rotation and the chain intends to enter therebetween while being twisted, it can forcibly corrected and the twist eliminated. Accordingly, the chain 16 can be prevented from being caught by the chain holder 17 to lock the load sheave 3.

Also, the rectangular projections 20 are provided at both the side surface of the chain holder 17 opposite to the side plates 1 and 2, and rectangular bores 21, engageable with the rectangular projections 20, are provided at the chain holder mounting portions at the side plates 1 and 2. The chain holders 17 are fixedly sandwiched between the side plates 1 and 2 by the stay bolts 22, whereby the chain holders 17 can effectively be locked and the insertion bores for the stay bolts, as in the conventional example, need not be provided, thereby enabling the present lever type traction machine to be miniaturized and to be simply machined and assembled.

While a preferred embodiment of the invention has been described using specific terms, such description is for illustrative purpose only, and it is to be understood that changes and variations may be made without departing from the spirit or scope of the following claims.

What is claimed is:

1. A lever type traction machine comprising:

a pair of side plates, spaced from one another;

a load sheave, rotatably interposed between said pair of side plates, for supporting and pulling a chain including vertical links and horizontal links;

an operating lever for driving said load sheave to pull said chain; and a pair of chain holders, fixed between said side plates at two radial sides of said load sheave, for holding said chain toward said load sheave so that said chain engages with said load sheave, each of said chain holders comprising:

(i) a first surface, which faces said load sheave, having a groove formed therein for receiving said vertical links, (ii) a second surface, which opposes said first surface, (iii) a chain swelling restraint portion provided at a rear portion of said chain holder with respect to an entering direction of said chain into said side plates, and (iv) a guide portion, provided at a front portion of said chain holder with respect to an entering direction of said chain into said side plates, including a first section that extends along a line tangential to a rotary path of said load sheave and a second section that extends outwardly, away from said load sheave, in an outwardly facing arc; wherein said guide portion corrects twists of said chain and comprises a first rounded correcting portion for correcting twists of said vertical links and a second rounded portion for correcting twists of said horizontal links.

2. A lever type traction machine according to claim 1, wherein each of said chain holders is provided, at the front with respect to the entering direction of said chain into said side plates, with a guide for correcting twist in said chain entering between said chain holder and said load sheave.

3. A lever type traction machine according to claim 1, wherein each of said chain holders is provided at both side surfaces thereof opposite to said side plates with rectangular projections projecting from said side surfaces respectively and each of said side plates is provided at a mounting portion of each of said chain holders with a rectangular fitting bore into which said rectangular projection is fitted, said side plates being fixed to each other by a plurality of stay bolts so that each of said chain holders is sandwiched between said side plates when fixed by said stay bolts.

4. A lever type traction machine according to claim 3, wherein said stay bolts are disposed at rear surface sides of said chain holders respectively, said rear surface of each of said holders being close to an outer surface of each of said stay bolts.

* * * * *